United States Patent [19]

Mijnheer et al.

[11] 4,019,336

[45] Apr. 26, 1977

[54] REFRIGERATOR

[75] Inventors: Andries Mijnheer; Albert Klaas De Jonge, both of Emmasingel, Netherlands

[73] Assignee: U.S. Philips Corporation, New York, N.Y.

[22] Filed: Aug. 7, 1975

[21] Appl. No.: 602,737

Related U.S. Application Data

[63] Continuation of Ser. No. 527,243, Nov. 26, 1974, abandoned.

[30] Foreign Application Priority Data

Sept. 11, 1973 Netherlands ..... 7312488

[52] U.S. Cl. ..... 62/6

[51] Int. Cl.[2] ..... F25B 9/00

[58] Field of Search ..... 62/6

[56] References Cited

UNITED STATES PATENTS

| | | | |
|---|---|---|---|
| 2,781,647 | 2/1957 | Kohler et al. | 62/6 |
| 3,148,512 | 9/1964 | Hoffman et al. | 62/6 |
| 3,413,802 | 12/1968 | Cowans | 62/6 |
| 3,688,512 | 9/1972 | Prast et al. | 62/6 |

*Primary Examiner*—Lloyd L. King
*Attorney, Agent, or Firm*—Frank R. Trifari

[57] ABSTRACT

A refrigerator in which the main regenerator has connected parallel thereto an auxiliary regenerator formed by a gap between the cooperating cylinder and displacer walls.

1 Claim, 1 Drawing Figure

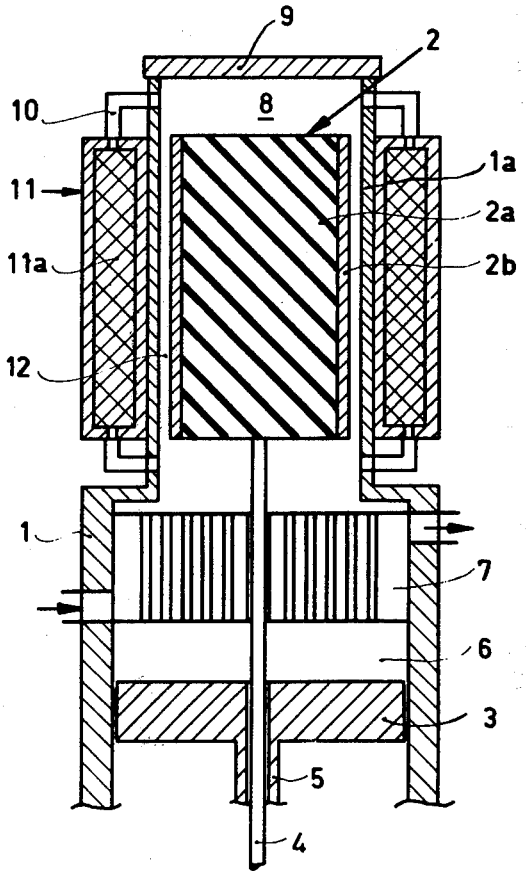
9
2
10
8
1a
11
2a
11a
2b
12
1
7
6
3
5
4

REFRIGERATOR

This is a continuation of application Ser. No. 527,243, filed Nov. 26, 1974, now abandoned.

The invention relates to a refrigerator comprising a compression space of variable volume and higher mean temperature during operation which communicates with an expansion space of lower mean temperature during operation, the volume of the said expansion space being variable by a displacer which is reciprocatable in a cylinder, the communication between the said spaces incorporating a regenerator through which a working medium can flow to and fro between the two spaces.

Refrigerators of the kind set forth are known.

Included in this kind are, for example, machines operating according to the Stirling cycle (U.S. Pat. Nos. 2,907,175 and 3,400,544), machines operating according to the Vuilleumier cycle (U.S. Pat. Nos. 1,275,507; 2,657,552 and 3,523,427) and machines of the Gifford-McMahon type (U.S. Pat. Nos. 2,906,101 and 2,966,035).

In such machines the regenerator normally consists of a filling mass of gas-pervious material (phosphor-bronze gauze layers, lead spheres etc.) contained in a housing. In order to minimize heat transport by gas leakage from the compression space of higher temperature level to the expansion space of lower temperature level, a seal, usually made of a synthetic material, is normally provided between the moving displacer and the cylinder wall. In addition to the cost of manufacture and mounting, this seal involves the drawback of, on the one hand, friction losses and, on the other hand, wear causing gas leakage, and also involving the risk of contamination of the regenerator by particles released from the seal because of the wear.

It will be obvious that it would be very advantageous if the seal could be dispensed with. The latter has indeed be realised in the refrigerator described in French Pat. No. 2,074,337, in which the regenerator is exclusively formed by an annular gap between the displacer wall and the cylinder wall, the hydraulic diameter of the said gap being between specific limits.

This may be a solution for small refrigerators of low cooling power, in which the entire small working medium flow can flow through the narrow gap from the compression space to the expansion space and vice versa substantially without flow loss and in proper thermal contact with the gap walls, but for the large refrigerators of comparatively high cooling power, and hence involving comparatively large working medium flows, this is not an attractive proposition. In the case of large working medium flows, the flow losses and a poor regenerative action become too dominant.

The present invention has for its object to provide a refrigerator of the kind set forth in which a high thermal efficiency is accompanied by the advantage of the absence of a seal between displacer wall and cylinder wall, not only for the small-cooling power category, but particularly also for the high-cooling power category.

To this end, the refrigerator according to the invention is characterized in that the communication between the said two spaces incorporates an auxiliary regenerator, connected parallel to the regenerator and formed by an annular gap between the displacer and the cooperating cylinder wall, at least one of the two facing surfaces of displacer and cylinder having a high thermal capacity with respect to the working medium flow through the gap during operation, the hydraulic diameter of the gap satisfying the relation:

$$0.4\, d_{h_o} \leq d_{h_o} \leq 1.4\, d_h$$

where $$d_{h_o} = 2.8 \sqrt[4]{\frac{s \cdot \eta^2 \cdot L}{\rho \cdot \Delta \cdot P}}$$

in which $d_h$ = hydraulic diameter of the gap $s$ = stroke length of the displacer $\eta$ = mean dimanic viscosity of the working medium in the gap $L$ = length of the gap $\Delta P$ = mean pressure drop across the regenerator $\rho$ = mean density of the working medium in the gap.

The major difference with respect to the refrigerator known from French Pat. No. 2,074,337 is that, whilst in this known machine the complete working medium flow passes through the gap regenerator, in the present case there are two working medium flows: a main flow through the normal regenerator and a secondary flow through the gap regenerator connected parallel to the normal regenerator. The normal regenerator has a mean pressure drop $\Delta P$ during operation, because of the flow loss due to flow resistance. This pressure drop $\Delta P$ makes itself felt across the gap regenerator, is "impressed" on the gap. In the known machine, comprising a regenerator which is exclusively formed by a gap, this gap is not subjected to a pressure difference from the outside, but the gap itself has a pressure drop because of flow losses. The said structural and physical differences in the present case necessitate the hydraulic diameter of the gap to satisfy a relation which is completely different from the relation given in the French Pat. Specification No. 2,074,337.

The hydraulic diameter of the regenerative gap is approximately equal to twice the gap width.

If the hydraulic diameter corresponding to the gap width of the auxiliary regenerator satisfies the relation given above, a proper heat transfer from the working medium secondary flow to the gap walls and vice versa is ensured, whilst the flow resistance of the working medium in the gap is low.

The invention will be described in detail hereinafter with reference to the drawing in which a diagrammatic, longitudinal sectional view is given of a refrigerator operating according to the Stirling cycle (cold-gas refrigerator) by way of example (not to scale).

The reference 1 in the figure denotes a cylinder. A displacer 2 and a piston 3 are reciprocatable in this cylinder. Displacer 2 is made of a synthetic material **2*a* of low thermal conductivity, enveloped by a thin stainless steel jacket 2*b*. The displacer 2 is connected to a drive not shown by way of a displacer rod 4, whilst the piston 3 is connected thereto by way of a piston rod 5. Present between piston and displacer is a compression space 6 accommodating a cooler 7. Situated above the displacer 2 is an expansion space 8, provided with a freezer 9 which is a heat-exchanger via which heat can be extracted from an object to be cooled by means of the cold produced in the expansion space 8**.

Compression space 6 and expansion space 8 are in open communication with each other via a regenerator 11 incorporated in a duct 10 and containing, for example, lead spheres as the filling mass 11*a*, and via an open gap 12 between the stainless-steel jacket 2*b* of displacer 2 and the cylinder wall 1*a* which is also made of stainless steel.

Also present in the refrigerator is a working medium, for example, helium.

On its way from compression space 6 to expansion space 8, the working medium mainly flows through regenerator 11 while giving off heat to regenerator filling mass 11*a*, and partly flows through gap 12 while giving off heat to the metal walls 1*a* and 2*b*. When flowing in the reverse direction, the working medium takes up the heat again stored in the filling mass 11*a* and in the walls 1*a* and 2*b*.

During operation a mean pressure difference ΔP prevails across regenerator 11, the said pressure difference making itself felt across gap 12. It has been found that a properly operating machine is obtained when the hydraulic diameter of the gap, corresponding to approximately twice the gap width, satisfies the relation:

$$0.4\, d_{h_o} \leq d_h \leq 1.4\, d_{h_o}$$

where $$d_{h_o} = 2.8 \sqrt[4]{\frac{s \cdot \eta^2 \cdot L}{\rho \cdot \Delta \cdot P}} \quad \text{in which}$$

$s$ = stroke length of the displacer
$\eta$ = mean dynamic viscosity of the working medium in the gap $L$ = length of the gap
$\rho$ = mean density of the working medium in the gap
$\Delta P$ = mean pressure drop across the regenerator.

If helium is used in the machine as the working medium and if the stroke length of the displacer $s = 10 \times 10^{-3}$m, the viscosity of the helium is $10^{-5}$ Ns/m², the gap length $L = 50 \times 10^{-3}$ m, the mean helium density in the gap $\rho = 4.8$ kg/m³, and the main pressure drop across the regenerator $$\Delta P = 0.25 \text{ atm.} = 0.25 \times 10^5 \text{ N/m}^2:$$

$$d_{h_o} = 2.8 \sqrt[4]{\frac{10 \times 10^{-3} \times 10^{-10} \times 50 \times 10^{-3}}{4.8 \times 0.25 \times 10^5}} =$$

$$= 2.8 \sqrt[4]{\frac{5 \times 10^{-14}}{1.2 \times 10^5}} = 2.8 \times 10^{-5} \sqrt[4]{\frac{50}{1.2}} = 2.8 \times 2.54 \times 10^{-5}$$
$$= 7.1 \times 10^{-5} \text{ m.}$$

The hydraulic diameter $d_h$ of the gap should then be:

$$2.8 \times 10^{-5}\, m \leq d_h \leq 9.9 \times 10^{-5} \text{ m.}$$

What is claimed is:

1. A refrigerator comprising a compression space of variable volume and higher mean temperature during operation which communicates with an expansion space of lower mean temperature during operation, the volume of the said expansion space being variable by a displacer which is reciprocatable in a cylinder, the communication between the said spaces incorporating a regenerator through which a working medium can flow to and fro between the two spaces, characterized in that the communication between the said two spaces incorporates an auxiliary regenerator, connected parallel to the regenerator and formed by an annular gap between the displacer and the cooperating cylinder wall, at least one of the two facing surfaces of displacer and cylinder having a high thermal capacity with respect to the working medium flow through the gap during operation, the hydraulic diameter of the gap satisfying the relation:

$$0.4\, d_{h_o} \leq d_h \leq 1.4\, d_{h_o}$$

where $$d_{h_o} = 2.8 \sqrt[4]{\frac{s \cdot \eta^2 \cdot L}{\rho \cdot \Delta \cdot P}} \quad \text{in which}$$

$d_h$ = hydraulic diameter of the gap
$s$ = stroke length of the displacer
$\eta$ = mean dynamic viscosity of the working medium in the gap
$L$ = length of the gap
$\rho$ = mean density of the working medium in the gap
$\Delta P$ = mean pressure drop across the regenerator.

* * * * *

UNITED STATES PATENT AND TRADEMARK OFFICE

CERTIFICATE OF CORRECTION

PATENT NO. : 4019336

DATED : April 26, 1977

INVENTOR(S) : ANDRIES MIJNHEER - ALBERT KLAAS DE JONGE

It is certified that error appears in the above-identified patent and that said Letters Patent are hereby corrected as shown below:

Col. 2, line 3, "$0.4d_{h_o} \leq d_{h_o} \leq 1.4d_h$" should be

--$0.4d_{h_o} \leq d_h \leq 1.4d_{h_o}$-- line 15, "dimanic" should be --dynamic--

Col. 2, line 9, )
Col. 3, line 31, )
Col. 4, In the Claim) (line 39) )

In each place, "$\Delta$.P" should be --$\Delta$P-- so that the equation is $$d_{h_o} = 2.8\sqrt[4]{\frac{s.\eta^2.L}{\rho.\Delta P}}$$

Signed and Sealed this

Twenty-second Day of November 1977

[SEAL]

Attest:

RUTH C. MASON
Attesting Officer

LUTRELLE F. PARKER
Acting Commissioner of Patents and Trademarks